United States Patent [19]

Kragt

[11] 4,179,788

[45] Dec. 25, 1979

[54] METHOD OF FABRICATING A BUILDING

[75] Inventor: Gerald A. Kragt, Marne, Mich.

[73] Assignee: Jer Manufacturing, Inc., Coopersville, Mich.

[21] Appl. No.: 926,806

[22] Filed: Jul. 21, 1978

Related U.S. Application Data

[62] Division of Ser. No. 853,104, Nov. 21, 1977, Pat. No. 4,115,967.

[51] Int. Cl.[2] ..... B23P 21/00; B23Q 3/00

[52] U.S. Cl. ..... 29/407; 29/428; 29/464; 20/469

[58] Field of Search ..... 29/407, 428, 469, 464; 33/174 B, 174 G; 52/64, 86, 90–93, 478, 643

[56] References Cited

U.S. PATENT DOCUMENTS

| | | | |
|---|---|---|---|
| 2,705,375 | 4/1955 | Foreman et al. | 29/464 |
| 3,339,268 | 9/1967 | Adams et al. | 29/464 X |
| 3,394,961 | 7/1968 | Matte | 52/64 X |
| 3,943,672 | 3/1976 | O'Sheeran | 52/86 X |
| 3,999,338 | 12/1976 | Behan et al. | 52/90 X |

*Primary Examiner*—E. M. Combs

*Attorney, Agent, or Firm*—Price, Heneveld, Huizenga & Cooper

[57] ABSTRACT

This invention relates to a building construction and method and a kit therefor wherein preferably a spaced front and back end panels are provided with spaced guide blocks positioned on the end panels for receiving therebetween purlins which extend between the end panels. Preferably a templet is used to determine the silhouette of the panels and the position of the guide blocks. The purlins are attached to each of the end panels and are guided to and supported in the correct position by the guide blocks. This construction is relatively simple and inexpensive by minimizing the requirement of fabrication of subassemblies such as rafter supports and the like.

3 Claims, 9 Drawing Figures

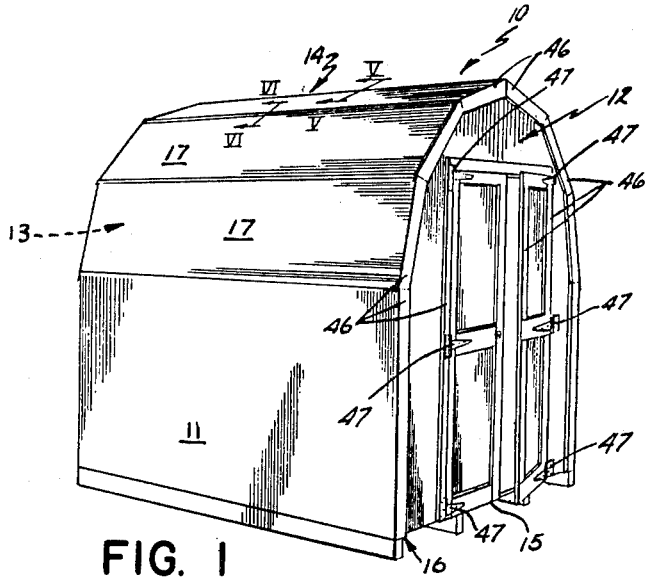
FIG. 1
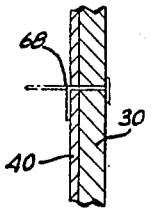
FIG. 8
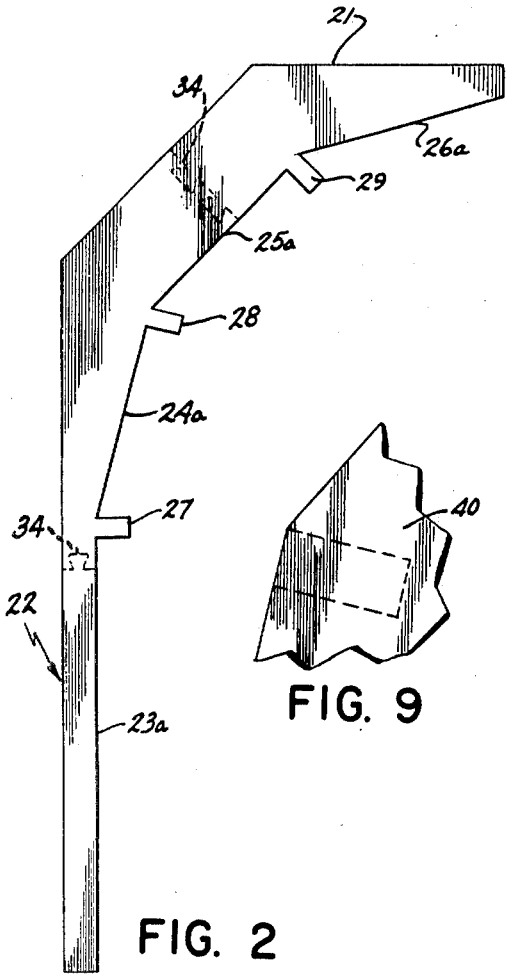
FIG. 2
FIG. 9
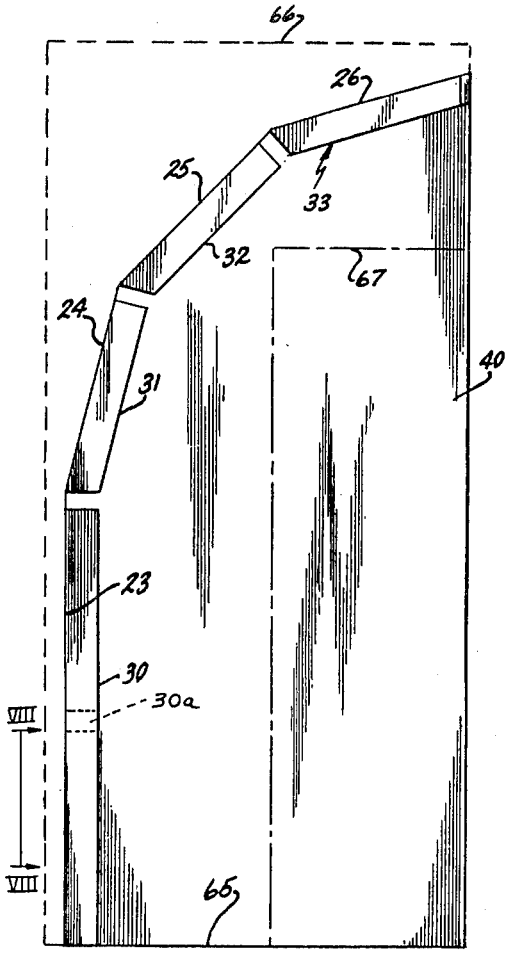
FIG. 3

METHOD OF FABRICATING A BUILDING

BACKGROUND OF THE INVENTION (1) Field of the Invention

This invention relates to building construction in general; and, more particularly, to the means for and method of constructing, a building and to a kit for sale in constructing a building.

(2) Prior Art

Wood yard buildings are known in the prior art and include various precut and prenumbered components which are used in conjunction with detailed illustrated instructions to complete the building.

For example, such a building construction can include fabrication of a base, attachment of sidewalls to the base, attachment of a rear wall to the base and sidewalls, and attachment of a front wall to the base and sidewalls opposite the rear wall. The framing of the roof has included fabricating subassemblies including rafters. These rafter roof subassemblies can resemble a pair of adjacent rectangles and are attached between the front and rear walls and to the sidewalls. The rafters in the subassembly extend parallel to the upper portions of the front and back end panels which define the roof silhouette.

A problem with such an assembly and construction as described above is that the rafter assembly must be separately constructed and then positioned within the already assembled side, back and front walls. As a result, a great deal of care must be taken to ensure that the sides of the rafter subassembly are of a shape and size to be positioned within the partially complete structure. Such a requirement for cooperation between two independently fabricated assemblies undesirably increases the skill and care required and the difficulty of construction.

It is desirable and this invention provides a building construction and method of constructing which is simpler, faster and uses less material while maintaining the desired strength of the building.

SUMMARY OF THE INVENTION

This invention advantageously utilizes the strength of front and rear end panels of a building and purlins extending between the end panels to support the roof structure. As a result in accordance with an embodiment of this invention, conventional rafter supports spaced from the end panels and rafter subassemblies need not be used. Further, a kit for the construction of a building in accordance with an embodiment of this invention can include a templet which defines the silhouette of the end panels of the building and the position of the purlins when they abut each end panel. The building construction kit also includes guide blocks which can be attached to the end panels at spaced positions to define a recess between the blocks. The blocks are positioned so that at the position of the recess the ends of the purlins join the end panels.

In accordance with an embodiment of this invention, the structural framework of the building is defined by the assembly of the purlins and the end panel and the remainder of the building is coupled to the framework. This is in contrast to the known prior art wherein the structural framework has components in addition to purlins and end panels and includes for example, rafter subassemblies which must be then fitted into a partially constructed structural framework. Supporting the purlins only adjacent the front and back end panels and, particularly, the use of guide means on the end panels for positioning the purlins, simplifies construction. Thus, this invention has the advantage of not only providing and easier construction and reducing fabrication time but also reducing the chance for error in construction of the building which could reduce the structural stability of the building. Pre-assembled rafter sub assemblies are eliminated from construction of the building, thus reducing time and expense of fabrication.

Also, greater advantage is taken of the structural stength of the end panels by transferring the weight of the roof on the purlins to the end panels. Indeed, in accordance with an embodiment of this invention, the silhouette of the end panels can advantageously have a generally arched shape to better support and distribute the weigth of the roof. That is, since an arch can carry weight better than a horizontal surface, the top silhouette of the end panels is closer to an arch than in the prior art.

BRIEF DESCRIPTION OF THE DRAWINGS

FIG. 1 is a front perspective view of a building in accordance with an embodiment of this invention;

FIG. 2 is a top plan view of a templet used to define the silhouette of half and end panel of construction material;

FIG. 3 is a front elevation view of the inside of half of an end panel for the building, the end panel having attached thereto guide blocks for receiving therebetween the ends of the purlin, and showing in dotted outline the edges of the portion removed from a rectangular construction sheet to form half the end panel;

FIG. 8 is a side elevational view taken generally along line VIII—VIII of FIG. 3 of the connection between a guide block and an end panel with a nail before bending shown in phantom; and FIG. 9 is top plan view of a portion of a cut end panel which has been marked in accordance with the templet.

DETAILED DESCRIPTION OF THE INVENTION

Figure 4:
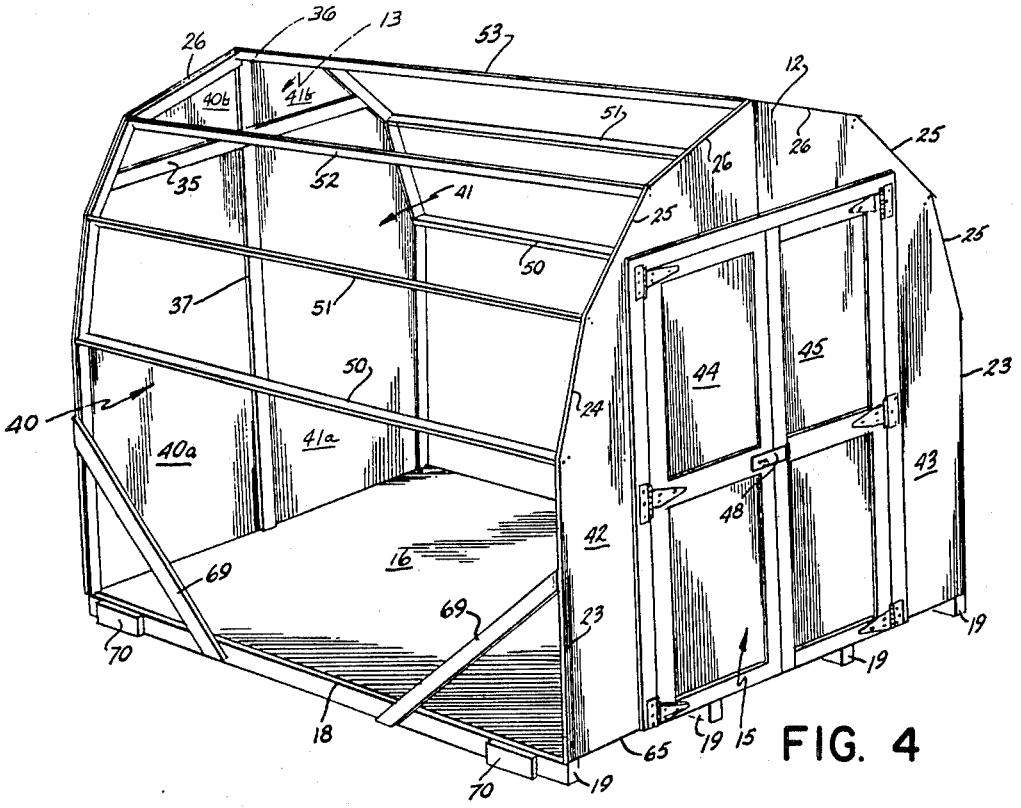
FIG. 4 is a front perspective view of a partially constructed building in accordance with an embodiment of the invention with the front and back end panels in place, including temporary construction braces.
Figure 7:
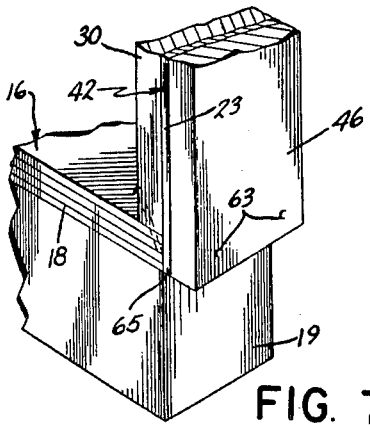
FIG. 7 is a front perspective view of a partially complete bottom corner of the building including the abutment of the floor and against the side of an end panel and a nail in phantom.

Referring to FIG. 1, a building 10 includes a generally rectangular base 16 upon which is positioned a front end 12 and an opposing back end 13 (FIG. 4). Generally rectangular and planar sidewalls 11 extend along opposing edges of base end 13. Extending between the top edges of ends 12 and 13 above sidewalls 11 and over base 16 is a roof 14 including roof sheathing or panels 17. Front end 12 has formed therein a door 15. Base 16 is formed of a generally planar piece of floor construction material 18 supported off the ground by a plurality of spaced joists 19. Alternatively, the base can be formed of concrete with protruding studs for attachment to side walls 11 and end 12 and 13. planar panels with a horizontal bottom edge 65 abutting the end of base 16, and a pair of generally vertical opposing side edges 23 abutting side walls 11 (FIG. 4). Referring to FIG. 7, a left front panel 42 forming half of front end 12 is attached by nails 63 to the front end of floor material 18 so that the bottom edge of front panel 42 is flush with the bottom surface of floor material 18. Nails 63 also connect a trim piece 46 to the outside of front panel 42. A side block 30 is attached to the inside of front panel 42 as later discussed and nailed to floor material 18 by a toed-in nail 64 shown in phantom. Extending between the upper portion of side edges 23 and opposite from bottom edge 65 is a six-sided roof edge, generally forming a six-sided arch between the upper portions of the two side edges 23. The roof edges include, in ascending order, a pair of lower roof edges 24, a pair of middle roof edges 25, and a pair of upper roof edges 26. Typically, the front and back ends 12 and 13 are formed from an integral number of standard 4′ by 8′ construction panels. For example, the bottom edge 65 of front end 12 can be less than 8′ long and the maximum height of front end 12 can be 8′ so the entire front end can be formed from two adjacent 4′ by 8′ panels with the silhouette of the end cutout. In the illustrated embodiment of FIGS. 1 and 4, two 4′ by 8′ panels have been used so that there is a left back panel 40, a right back panel 41, a left front panel 42 and a right front panel 43.

Referring to FIG. 3, left back panel 40 has a plurality of guide blocks positioned around the side and roof edges and spaced from one another to receive therebetween ends of purlins extending from front end 12 to back end 13. More specifically, a side block 30 extends from the bottom edge 65 of left back panel 40, along side edge 23 to the first of three roof edge portions. Extending along the roof edge portions, but spaced from one another, are, in order, lower roof block 31 along lower roof edge 24, middle roof block 32 along middle roof edge 25, and upper roof block 33 along upper roof edge 26. Referring to FIG. 4, each of panels 40, 41, 42 and 43 have a similar arrangement of blocks 30, 31, 32 and 33 so that purlins can extend between ends 12 and 13 and be positioned between adjacent blocks in each end. That is, a lower purlin 50 extends between the opposing spaces between blocks 30 and 31, a middle purlin 51 extends between the opposing spaces between blocks 31 and 32, an upper purlin 52 extends between the opposing spaces between blocks 32 and 33, and a peak or ridge purlin 53 extends between the opposing spaces between adjacent blocks 33 on adjacent panels 40, 41 and 42, 43. In all, there are seven purlins extending between front and back ends 12 and 13. If additional rigidity is desired, block 30 can be transversely cut into two pieces and a space **30*a* (shown in dotted outline on FIG. 3) formed halfway up side edge 23. Thus, an additional purlin can be used extending between the midpoints of opposing side edges 23. The purlins not only improve the relative stability of the front and back panels but provides an additional anchoring point for attaching side walls 11**.

Figure 5:
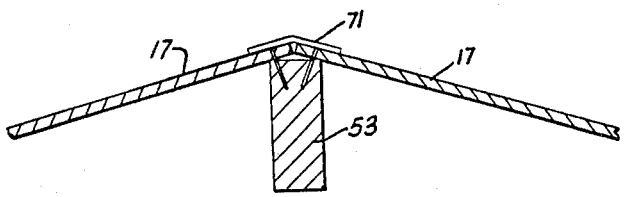
FIG. 5 is a vertical section view of the ridge of the building taken generally along line V—V of FIG. 1.
Figure 6:
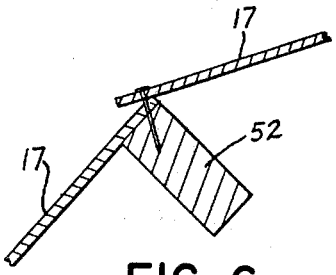
FIG. 6 is a vertical section view of the ridge of the building taken generally along line VI—VI of FIG. 1.

Referring again to FIG. 1, roof 14 consists of a plurality of roof panels 17 which have a length somewhat longer than the length of a purlin and a width about equal to the separation between adjacent purlins. Sidewalls 11 are somewhat longer than the length of a purlin so they can extend flush with the front surface of trim 46 (FIG. 7) and about equal in width to the distance between lower purlin 50 and base 16. The upper edge of sidewall 11 is connected to lower purlin 50 and the lower edge of sidewall 11 overlaps and is connected to floor material 18. Roof panels 17 overlap each other as shown in FIGS. 5 and 6. The roof panel 17 between lower purlin 50 and middle purlin 51 is connected to and flush against the outer edge of middle purlin 51 and overlaps sidewall 11 and lower purlin 50. Similarly, a roof panel 17 will overlap the roof panel 17 just below it. FIG. 6 shows a nail 69 extending through two overlapping roof panels 17 into purlin 52.

The contents of a kit to fabricate building 10 includes a templet 20 shown in FIG. 2. In accordance with one embodiment of this invention, templet 20 fits over a standard size panel and can be used to guide the tracing of the silhouette of panels 40, 41, 42 and 43. Templet 20 includes a width alignment edge 21 for lining up along the width or transverse edge of a standard size panel and a length alignment edge 22 for aligning along the longitudinal edge of the standard panel. Templet 20 can be a single piece, or be cut along dotted lines 34 shown in FIG. 2 into three pieces. Advantageously, as shown, the cuts along dotted lines 34 form interlocking dovetail pieces which can be easily and securely assembled and disassembled. A typical material for templet 20 is corrogated cardboard.

For defining the silhouette of the end panels, templet 20 has a side edge **23*a* which defines the edge of the end panel to abut sidewall 11. Side edge 23*a* is parallel to length alignment edge 22 and is spaced from alignment edge 22. Adjacent side edge 23*a* is a lower roof edge 24*a* which is angled from side edge 23*a* 15° and separated from side edge 23*a* by a lower notch 27 which is sufficiently wide to provide space for the abutment of lower purlin 50. A middle notch 28 is between lower roof edge 24*a* and an adjacent middle roof edge 25*a*. Similarly, an upper notch 29 is between middle roof edge 25*a* and an upper roof edge 26*a*. Middle notch 28 provides for the abutment of middle purlin 51 and upper notch 29 provides for the abutment of upper purlin 52**.

Middle roof edge **25*a* is at an approximately 45° angle from the vertical and upper roof edge 26*a* is at an approximately 15° angle from the horizontal. If purlins 50, 51, 52 and 53 use standard 2″ by 4″ lumber then the width of each of notches 27–29 is about 1½ inches. The tracing of notch 28 on left back panel 40 is shown in FIG. 9**.

A kit also advantageously includes the blocks 30, 31, 32, 33 which are typically various lengths of 1″ by 4″ lumber which lengths correspond with the edges 23, 24, 25, and 26. Side blocks 30 extend along side edges 23, lower roof blocks 31 extend along lower roof edges 24, middle roof blocks 32 extend along middle roof edges 25 and upper roof blocks 33 extend along upper roof edges 26. Upper roof block 33 is chosen to be sufficiently short so that when the sides of panels 40 and 42, are abutted to the sides of panels 41 and 43, respectively, there is enough space between adjacent upper roof blocks 33 to pass ridge purlin 53. The ends of blocks 30, 31, 32 and 33 are angled so that ends of adjacent blocks are parallel and so that when purlins 50-53 are positioned between adjacent ends an edge of the purlin faces outwardly and generally parallel to the adjacent one of side or roof edges 23–26. The position of blocks 30–33 on left back panel 40 is shown in FIG. 3 as is a dotted outline 66 of the portion of a standard size panel removed to form panel 40. Also shown is a dotted outline 67 where panel 40 is cut to form one-half of door 15. Trim pieces 46 are attached along both sides of outline 67 and along the periphery of each half of door 15 to reinforce the edges of door 15 and to mount hinges 47 (FIGS. 1 and 4). FIG. 8 shows how a block such as 30 is nailed to panel 40 and a nail 68 protruding beyond the back of panel 40 bent down.

The additional components of building 10 are advantageously formed of standard size lumber and can be formed relatively quickly using straight cuts and templet 20. Thus, if 4' by 8' panels are used the distance between front and back ends 12 and 13 is about 8' and the distance between adjacent purlins 50, 51, 52, and 53 is about 4' so each panel can be cut longitudinally in the middle to form two roof panels 17. Advantageously, sidewall 11 is the size of one 4' by 8' panel. The components of building 10 are connected and assembled by the use of nails.

Referring to FIG. 4, door 15 has symetric opposing door sections 44 and 45 formed cutout of a portion of panels 42 and 43, respectively. Elongated trim pieces 46 around the periphery of sections 44 and 45 and those portions of panels 42 and 43 adjacent door sections 44 and 45 provide reinforcement for door 12 (FIG. 1). Further, six hinges 47, three on each side, are mounted on trim pieces 46 to pivotally mount door sections 44 and 45 to panels 42 and 43, respectively. A hasp 48 is attached to door 15 so it can be locked. A typical material for trim pieces 46 is 1" by 4" lumber with a length equal to the length of the edge adjacent to which they are mounted.

A kit in accordance with an embodiment of this invention can also include all of the necessary components cut to the correct size and, if desired, partly prefabricated. For example, a kit can include precut end panels, purlins, guide blocks, floor material, joists, side walls, roof panels, trim pieces and hardware. If the end panels are already cut, there is no need to include templet 20 as part of the kit. However, because of the size of the end panels, it is desirable to cut off the top portion of the end panels to facilitate shipping. An advantageous cut to make in panels 40, 41, 42 and 43 is a horizontal cut six feet up from the bottom. This not only reduces the shipping dimensions of the pieces to be shipped, but forms the top edge of door 15.

Referring to FIG. 4, left back panel 40 includes a lower portion **40*a* and an upper portion 40*b* attached to each other by a horizontal lumber piece 35. Similarly, right back panel 41 includes a lower portion 41*a* and an upper portion 41*b* attached to each other by an extension of lumber piece 35. Upper portions 40*b* and 41*b* are attached to each other by a vertical lumber piece 36 and lower portions 40*a* and 41*a* are connected to each other by a vertical lumber piece 37. Lumber pieces 35, 36 and 37 are typically 1" by 4", but can be 2" by 4", and are nailed to adjacent panel portions so each lumber piece overlaps both adjacent panels. If desired, upper portions 40*b* and 41*b* can be preassembled to each other so a kit for back end panel 13 includes three separate panel portions, the first being panel portion 40*a*, the second being panel portion 41*a*, and the third being the combination of panel portions 40*b* and 41*b*. Further, door 15 can be completely formed by attaching trim pieces 46 around panels 44 and 45. Still further, the components of building 10 can be painted so that painting is not required after assembly. It can be appreciated that the relative size of pieces 40*a* and 40*b*, and 41*a* and 41*b* can be varied so there is a horizontal lumber piece extending between the ends of purlins 50 across the back of building 10. In such a case, a lumber piece longer and positioned lower than piece 35 is used instead of lumber piece 35**.

METHOD OF ASSEMBLY

To fabricate a building 10 in accordance with an embodiment of this invention, templet 20 is positioned on a 4' by 8' sheet of siding so that the width alignment edge 21 is along the 4' side of the sheet and length alignment edge 22 is along the 8' side of the sheet. The outline of the templet is marked on the sheet so there is drawn side edge **23*a*, lower roof edge 24*a*, middle roof edge 25*a*, upper roof edge 26*a*, lower notch 27, middle notch 28 and upper notch 29. When marking, if one side of the siding has grooves, or an otherwise irregular surface, the opposite side should be marked. The siding is then cut along the side edge 23, and roof edges 24, 25 and 26. Notches 26, 27, 28 and 29 are just marked and not cut out (FIG. 9). The notches mark the outline for the abutting of purlins 50, 51 and 52 against the siding. Depending upon how templet 20 is positioned on the siding, there is formed either a left back panel 40, right back panel 41, left front panel 42 or right front panel 43**.

Blocks 30, 31, 32 and 33 are positioned on edges 23, 24, 25 and 26, respectively. These blocks are typically elongated 1" by 4" pieces of lumber with their ends cut so that adjacent blocks have parallel ends. Thus, there is a slot between adjacent blocks having parallel sides which is at least 1½ inches wide and is suitable for receiving 2" by 4" purlins.

Door 15 is formed by cutting opposing sections 44 and 45 from left front panel 42 and right front panel 43, respectively. Typically, each door section has a length of 6' and a width of 2'. Further, trim pieces 46 are attached by nails to the periphery of each of door sections 44 and 45 and around the adjacent panels of 42 and 43. As noted, trim pieces 46 add additional reinforcement and can be used for attaching hinges 47 and other hardware. A particularly advantageous method of fabrication is to attach a trim piece which is double the width of trim piece 46 around the outline of door 15 so half of the trim piece is on each side of the cut to be made. Thus when sections 44 and 45 are cut from panels 42 and 43, trim pieces 46 are cut longitudinally in half. As the cut is made around the periphery of door 15 hinges 47 are attached sequentially. As a result, door 15 has a perfect fit and need not be hung. A trim piece (not shown) can be attached to the inside of the vertical center seam in door 15 to seal any space between adjacent door panels and to act as a door stop.

Base 16 is formed of two adjacent 4' by 8' sheets of floor material 18 laid crosswise thus giving a floor area of about 8' by 8'. Of course, different sizes of building 10 floor space are possible. Floor material 18 is raised from the ground by parallel 4" by 4" lumber joists 19 connected across adjacent sheets of material 18. After front and back ends 12 and 13 are fabricated, including door 15, they are attached by nails to the front and back of base 16 (FIG. 7). Additional temporary stability during assembly can be provided by having an angular brace 69 (FIG. 4) extending between the sides of front end 12 and base 16. Such a brace is removed before sidewalls 11 are attached.

After front and back ends 12 and 13 are standing upright from base 16, purlins 50, 51, and 52 are positioned into notches 27, 28, and 29 on both front and back ends 12 and 13. The notch for purlin 53 is formed between adjacent upper roof blocks 33. To secure the purlin, 8D, or penny nails can be driven through the end panels and longitudinally into the purlins. When the purlins are in place, sidewalls 11 are positioned between lower purlin 50 and base 16 and between front and back ends 12 and 13. To facilitate installation of side walls 11 so the bottom of side wall 11 is flush with the bottom of floor material 18, temporary support blocks 70 are attached to the side of joists 19 so side wall 11 can rest on the top of blocks 70 while it is nailed to front and back ends 12 and 13, purlin 50 and floor material 18. After a sidewall 11 is attached on one side of building 10, a sidewall 11 is attached to the other side also.

Three 4' by 8' panels are cut longitudinally along their center axes to form six 2' by 8' panels which are positioned between purlins 50, 51, 52 and 53 and adjacent the roof edges 24, 25, 26 of each of the front and back ends 12 and 13. If desired, the installation of ridge purlin 53 can be delayed until after sides 11 are attached. To increase the water tightness of building 10, the top edge of the lower roof panels 17 should be tucked under the lower edge of the higher roof panels (FIG. 6). Nails, such as an 8D penny nail, are then driven through both of the overlapping roof panels and into the underlying purlin. Further, to insure water tightness a strip of waterproof material 71 can be placed along the joint between the two uppermost roof panels 17 above ridge purlin 53 (FIG. 5). Building 10 can be painted and stained if desired and can include the addition of shingles on panels 17 of roof 14.

When the building construction kit includes all prefabricated components, no cutting is necessary and just assembly of all the components is required. However, as mentioned above, the end panels come in three pieces for ease of shipment. In this case the bottom portions such as **40*a* and 41*a* of back end panel 13 and the lower portion, including the assembled door and trim pieces 46, of front end panel 12 are attached to base 16. The upper portions are then attached by a horizontal lumber piece (e.g. piece 35**) on the inside of the lower portions of the end panels.

Various modifications to the preferred embodiments will, no doubt, occur to those skilled in the various arts to which this invention pertains. For example, the particular sizes of the building components may be varied from that disclosed above. Further, the building may also include windows. These and all other variations which basically rely on the teachings through which this disclosure has advanced the art are properly considered within the scope of this invention as defined by the appended claims.

I claim:

1. A method of fabricating a building having a pair of end panels connected by purlins for supporting roof panels, said method including the steps of:

placing a templet on a building panel, said templet defining a silhouette on said building panel of at least a portion of the end panel of the building and also defining the position of purlins to be secured to said panels;

tracing the outline of said templet on said building panel thereby defining said silhouette and also indicating the placement of the abutting ends of a plurality of purlins to be extended between the end panels on the building panel;

cutting the traced silhouette of the end panel from the building panel while retaining the definition of the position of the placement of said ends of said purlins, attaching raised guide means to the building panel, said guide means being positioned in accordance with the said definition thereby being spaced from one another so that the indicated placement of the abutting purlin ends is established, extending purlins between the end panels; and attaching the purlins to the end panels at a position between said guide means; and attaching the roof panels to adjacent purlins and between aligned guide means on opposing end panels of the building.

2. A method of fabricating a building having a roof, sidewalls, and end walls comprising the steps of:

providing a pair of end panels each formed by sheet material and having generally the same silhouette including roof line and sidewall edges extending from the floor to the roof line;

placing a template on said end panels, said template defining a silhouette of at least a portion of the end panel of the building and also defining the position of purlins to be secured to said panels;

attaching guide means to the inside surface of each of said end panels by positioning said guide means in accordance with a location determined by said template to establish the location for positioning the ends of purlins;

providing a plurality of purlins having a length generally equal to the distance separating said end panels and attaching said purlins to said end panels so that the ends of said purlins cooperate with said panels to form the frame structure for the building, said purlins including roof purlins located at spaced intervals along said roof line edges each of said guide means and at least one purlin located adjacent each of the junctures of the roof line edges and sidewall edges of said end panels; and attaching side and roof panel members to the outer edges of said purlins and said end panels thereby enclosing the building.

3. The method of fabricating a building as defined in claim 2 wherein the step of placing a template on the panel further includes:

the step of tracing the outline of said template on said panel thereby defining said silhouette and indicating the placement of the abutting ends of the plurality of purlins to be extended between the end panels; and cutting the traced silhouette of the end panel from the building panel while retaining the definition of the position of the placement of said ends of said purlins.

* * * * *

UNITED STATES PATENT AND TRADEMARK OFFICE

CERTIFICATE OF CORRECTION

PATENT NO. : 4,179,788

DATED : December 25, 1979

INVENTOR(S) : Gerald A. Kragt

It is certified that error appears in the above-identified patent and that said Letters Patent are hereby corrected as shown below:

Col. 1, line 33;
"complete" should be ---completed---;

Col. 2, line 17;
"weigth" should be ---weight---;

Col. 2, line 26;
"and" should be ---an---;

Col. 2, line 60;
After "base" insert ---16 between front end 12 and back---;

Col. 2, line 68;
After "13." insert ---Front end 12 and back end 13 are generally---.

Signed and Sealed this

*Twenty-fourth* Day of *June 1980*

[SEAL]

*Attest:*

SIDNEY A. DIAMOND

*Attesting Officer*

*Commissioner of Patents and Trademarks*